United States Patent [19]

Kiuchi et al.

[11] 4,350,131

[45] Sep. 21, 1982

[54] FUEL INJECTION DEVICE OF AN INTERNAL COMBUSTION ENGINE

[75] Inventors: Hideo Kiuchi, Aichi; Nobuyuki Kobayashi, Toyota, both of Japan

[73] Assignee: Toyota Jidosha Kogyo Kabushiki Kaisha, Toyota, Japan

[21] Appl. No.: 164,882

[22] Filed: Jun. 30, 1980

[30] Foreign Application Priority Data

Jul. 16, 1979 [JP] Japan ..... 54-90698

[51] Int. Cl.[3] ..... F02D 3/02; F02D 5/00

[52] U.S. Cl. ..... 123/453; 123/454; 123/489; 123/491; 261/50 A

[58] Field of Search ..... 123/454, 453, 452, 482, 123/489, 455, 491, 440; 261/50 A; 60/276, 285

[56] References Cited

U.S. PATENT DOCUMENTS

| | | | |
|---|---|---|---|
| 3,745,768 | 7/1973 | Zechnall et al. | 60/276 |
| 3,974,811 | 8/1976 | Stumpp et al. | 123/454 |
| 3,981,288 | 9/1976 | Wessel | 123/454 |
| 3,993,032 | 11/1976 | Passera et al. | 123/452 |
| 4,018,200 | 4/1977 | Stumpp et al. | 123/454 |
| 4,167,924 | 9/1979 | Carlson et al. | 123/440 |
| 4,173,952 | 11/1979 | Asano | 123/440 |
| 4,186,708 | 2/1980 | Bowler | 123/445 |
| 4,230,083 | 10/1980 | Wessel et al. | 261/50 A |

FOREIGN PATENT DOCUMENTS 1513434 6/1978 United Kingdom ..... 123/454

*Primary Examiner*—Ronald B. Cox
*Assistant Examiner*—Andrew M. Dolinar
*Attorney, Agent, or Firm*—Stevens, Davis, Miller & Mosher

[57] ABSTRACT

A fuel injection device comprising an injection unit having a back pressure chamber and a fuel chamber which are separated by a diaphragm. The fuel chamber has on its lower end a fuel nozzle. A needle, cooperating with the fuel nozzle, is connected to the diaphragm. A flow control valve is arranged in the fuel feed passage connecting the fuel chamber to the fuel feed pump. The amount of the fuel injected from the fuel nozzle is controlled by the flow control valve so as to be proportional to the amount of the air sucked in. One end of the back pressure chamber is connected, to the pressure reducing chamber of the pressure reducing valve via a restricted opening and, the other end is connected to the fuel tank via the fuel return passage. An electromagnetic valve is arranged in the fuel return passage. An oxygen concentration detector is arranged in the exhaust passage of an engine. The electromagnetic valve is controlled by the oxygen concentration detector for equalizing the air-fuel ratio of the mixture, fed into the cylinders of an engine, to the stoichiometric air-fuel ratio.

6 Claims, 12 Drawing Figures

FUEL INJECTION DEVICE OF AN INTERNAL COMBUSTION ENGINE

DESCRIPTION OF THE INVENTION

The present invention relates to a fuel injection device having a novel construction for use in an internal combustion engine.

There has been proposed a fuel injection device of a continuous injection type, which has a metering slot and a single injection nozzle common to all the cylinders of an engine. In this fuel injection device, the amount of the fuel injected from the injection nozzle is increased proportionally to an increase in the flow area of the metering slot. This metering slot is formed in the intersecting zone of the opening of the stationary member and the opening of the rotatable member, and the rotatable member is directly driven by a rotatable controlling body arranged in the intake passage and rotated proportionally to an increase in the amount of the air sucked in. Consequently, in this fuel injection device, the amount of fuel injected from the injection nozzle is increased proportionally to an increase in the amount of the air sucked in.

As is known to those skilled in the art, in order to simultaneously reduce the amount of harmful HC, CO and $NO_x$ components in the exhaust gas, a method of using a three way catalizer has been known. This three way catalizer has a maximum purifying efficiency when an air-fuel ratio of the mixture, fed into the cylinders of an engine, becomes equal to the stoichiometric air-fuel ratio. Consequently, in a case wherein such a three way catalizer is used, it is necessary to precisely equalize an air-fuel ratio of the mixture, fed into the cylinders, to the stoichiometric air-fuel ratio. As mentioned above, in a conventional fuel injection device, it is true that the amount of the fuel injected from the injection nozzle is increased proportionally to an increase in the amount of the air sucked in. However, in the fuel injection device of the prior art, it is difficult to precisely equalize an air-fuel ratio of the mixture, fed into the cylinders, to the stoichiometric air-fuel ratio.

An object of the present invention is to provide a fuel injection device of a continous injection type, which is capable of precisely equalizing an air-fuel ratio of the mixture, fed into the cylinders, to the stoichiometric air-fuel ratio.

According to the present invention, there is provided a fuel injection device of an internal combustion engine having an intake passage and an exhaust passage, said device comprising: a fuel reservoir; fuel feed means connected to said fuel reservoir and discharging fuel of a constant pressure; an injector unit having a fuel chamber, a back pressure chamber, a diaphragm separating said fuel chamber from said back pressure chamber, and a plunger operatively connected to said diaphragm, said fuel chamber having a fuel nozzle which opens into said intake passage and cooperates with said plunger for forming a mixture in said intake passage; a fuel feed passage connecting said fuel feed means to said fuel chamber; flow control means arranged in said fuel feed passage for controlling the flow of a fuel to feed the fuel into said fuel chamber in an amount which is proportional to the amount of sucked air flowing within said intake passage; pressure reducing means connected to said fuel feed means and having a pressure reducing chamber for maintaining a fuel within said pressure reducing chamber at a constant pressure which is smaller than the constant pressure of the fuel discharged from said fuel feed means, said pressure reducing chamber being connected to said fuel chamber via a restricted opening; a fuel return passage connecting said fuel chamber to said fuel reservoir; an oxygen concentration detector arranged in said exhaust passage for alternately producing a low level signal and a high level signal, said low level signal representing an air-fuel ratio of said mixture that is larger than the stoichiometric air-fuel ratio, said high level signal representing an air-fuel ratio of said mixture that is less than the stoichiometric air-fuel ratio; control means for producing continuous output pulses having a constant period, but variable pulse widths which vary in response to said low level signal and said high level signal; and, valve means arranged in said fuel return passage for controlling a flow area of said fuel return passage in response to the output pulses of said control means to reduce and increase the pressure in said back pressure chamber when said oxygen concentration detector produces said low level signal and said high level signal, respectively.

The present invention may be more fully understood from the description of a preferred embodiment of the invention set forth below, together with the accompanying drawings.

DESCRIPTION OF A PREFERRED EMBODIMENT

Figure 1:
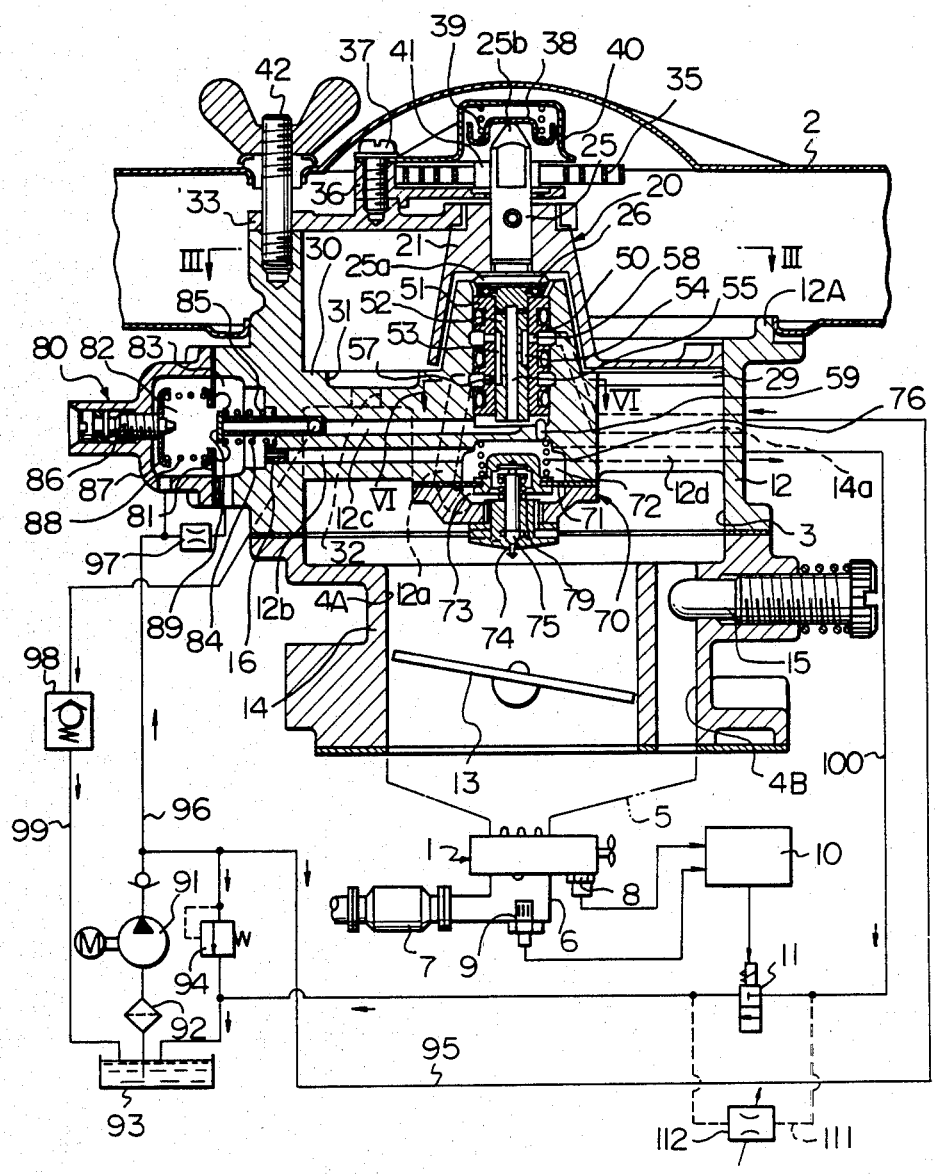
FIG. 1 is a cross-sectional side view of a fuel injection device according to the present invention, taken along the line I—I in FIG. 3.

Referring to FIG. 1, 1 designates a spark ignition type internal combustion engine, 2 an air cleaner, 3 an intake passage, 4A a main intake passage connected to the outlet of the intake passage 3; 4B designates an auxiliary intake passage connected to the outlet of the intake passage 3 and arranged in parallel to the main intake passage 4A; 5 designates an intake manifold connected to the outlets of the main and auxiliary intake passages 4A and 4B; 6 designates an exhaust manifold, 7 a three way catalytic converter connected to the outlet of the exhaust manifold 6; 8 designates a temperature detector for detecting the temperature of the cooling water of the engine 1; 9 designates an oxygen concentration detector arranged in the exhaust manifold 6; 10 designates an electronic control circuit and 11 an electromagnetic valve. The electromagnetic valve 11 is controlled by the electronic control circuit 10 on the basis of the output signals of the temperature detector 8 and the oxygen concentration detector 9 as hereinafter described in detail.

The intake passage 3 is formed in a generally cylindrical fuel injector body 12, and the main and auxiliary intake passages 4A and 4B are formed in a throttle duct 14. A throttle valve 13 is arranged within the main intake passage 4A and connected to an accelerator pedal (not shown) arranged in the driver's compartment. In addition, an idle ajusting screw 15 is arranged in the auxiiary intake passage 4B. A projection 12A is formed in one piece on the top of the injector body 12. The inner end of the lower member of the air cleaner 2 is fitted on the outer wall of the projection 12A and fixed onto the injector body 12 by means of bolts 42 (only one shown). As illustrated in FIG. 1, the injector body 12 is provided with an instrument 20 for sucking-in a controlled amount of air. Ambient air is sucked into the intake passage 3 via the air cleaner 2 and the instrument 20 and then introduced into the main intake passage 4A and the auxiliary intake passage 4B. As described hereinafter in detail, fuel is injected from the injector body 12 towards the throttle valve 13 and, thus, an air-fuel mixture is formed within the main intake passage 4A. After this, the mixture thus formed is fed into the cylinders of the engine 1 via the intake manifold 5.

Figure 2:
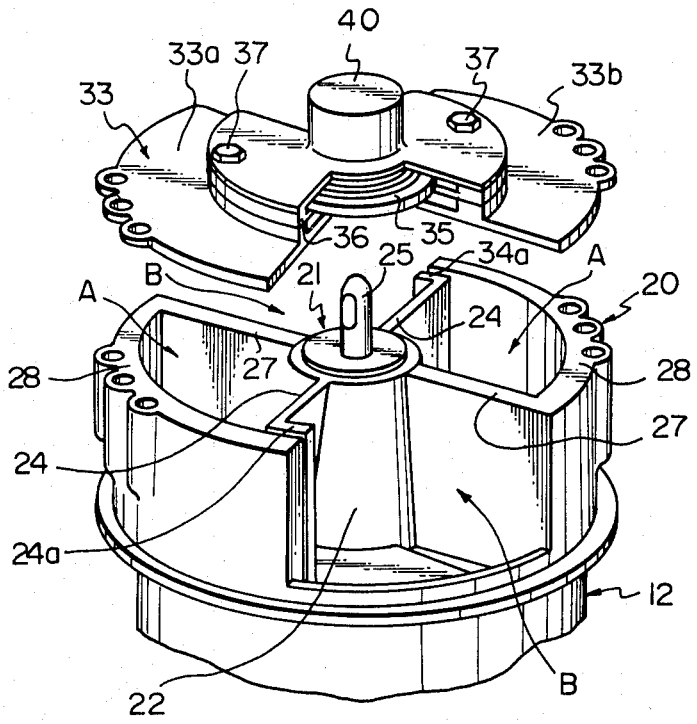
FIG. 2 is a perspective view of an instrument for sucking-in a controlled amount of air, shown with the lid member removed.
Figure 3:
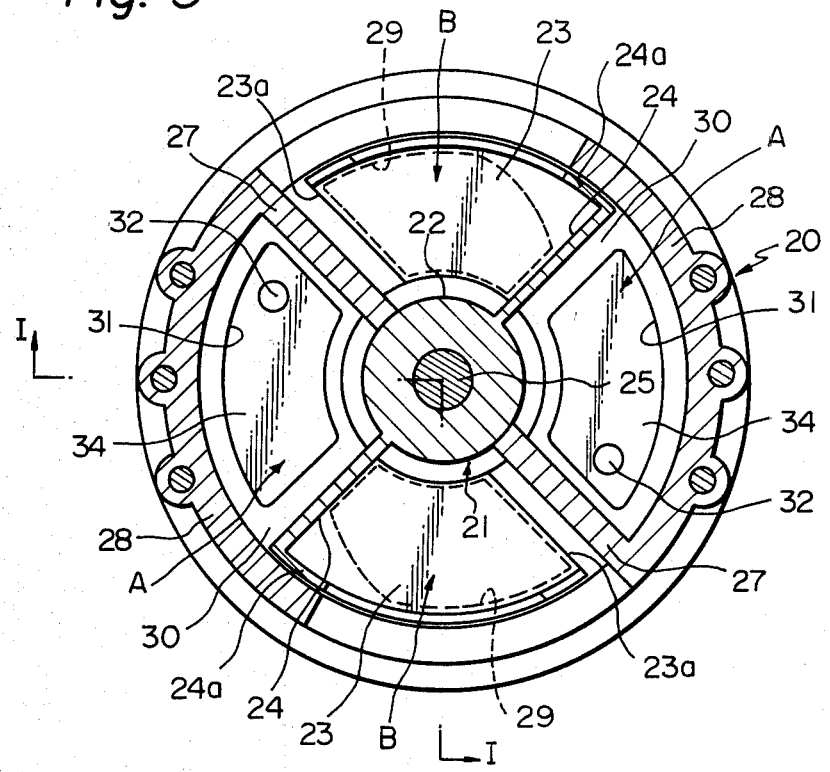
FIG. 3 is a cross-sectional plan view of an instrument for sucking-in a controlled amount of air, taken along the line III—III in FIG. 1.
Figure 4:
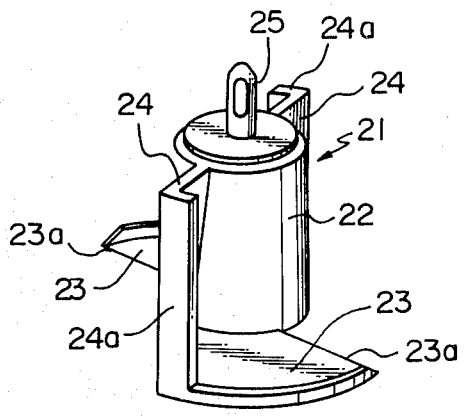
FIG. 4 is a perspective view of a controlling body of the instrument illustrated in FIG. 2.
Figure 5:
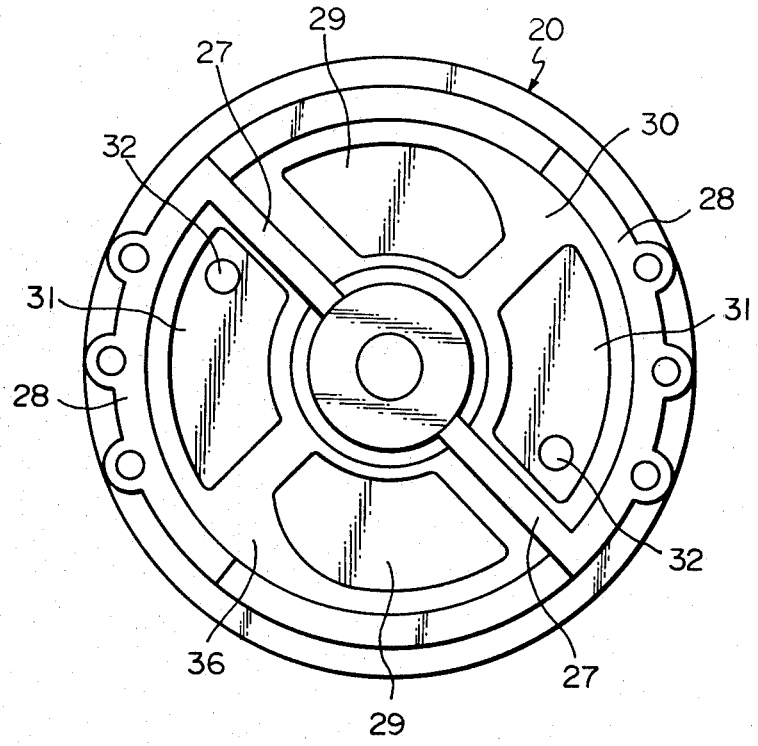
FIG. 5 is a plan view of a casing of the instrument illustrated in FIG. 2, shown with the lid member and the controlling body removed.

As illustrated in FIGS. 1 through 5, the instrument 20 comprises a pair of arc shaped outer casings 28 formed in one piece with the injector body 12, a lid member 33, and a controlling body 21. The controlling body 21 has a conical bass portion 22 and is fixed onto a rotatable shaft 25 which is rotatably supported by the injector body 12. In addition, the controlling body 21 comprises a pair of radially extending vertical walls 24, a pair of curved peripheral walls 24*a* extending along the cylindrical inner walls of the casings 28, and a pair of sector shaped bottom walls 23. In addition, the edge 23*a* of each of the bottom walls 23 is shaped in the form of a knife edge. As illustrated in FIGS. 3 and 5, a pair of radially extending vertical walls 27 and a bottom wall 30 are formed in one piece on the cylindrical inner wall of the casings 28. In addition, a pair of sector shaped openings 29 and a pair of sector shaped grooves 31 are formed on the bottom wall 30. Furthermore, a pair of vacuum holes 32 is formed on the bottom wall 30 in the sector shaped grooves 31. As illustrated in FIG. 1, a coil spring 35 is arranged on the top of the shaft 25. In addition, a spring holder 36 is arranged beneath the coil spring 35, and a cover 40 is arranged above the coil spring 35. The spring holder 36 is fixed onto the lid member 33 by means of bolts 37, together with the cover 40. A shaft retainer 38 is arranged on the tip of the shaft 25, and a compression spring 39 is inserted between the shaft retainer 38 and the cover 40. The inner end of the coil spring 35 is connected to a boss member 41 which is fixed onto the shaft 25, and the outer end of the coil spring 35 is connected to the spring holder 36 so that the controlling body 21 is always biased in the counterclockwise direction in FIG. 2 by the coil spring 35. The coil spring 35 provides an approximately constant torque to the controlling body 21, in spite of the position of the controlling body 21. As illustrated in FIG. 2, the lid member 33 has a pair of sector portions 33*a*, 33*b* which are arranged to cover regions A, each being defined by the vertical walls 24 and 27, the casing 28 and the bottom wall 30 (FIG. 3). These regions A are only connected to the intake passage 3 (FIG. 1) via the corresponding vacuum holes 32. Contrary to this, regions illustrated by B in FIGS. 2 and 3 open into the inside of the air cleaner 2 (FIG. 1) and are connected to the intake passage 3 (FIG. 1) via the corresponding sector shaped openings 29. The sector shaped bottom walls 23 of the controlling body 21 cooperate with the corresponding sector shaped openings 29 for changing the flow area of the sector shaped openings 29.

In operation, ambient air is sucked into the intake passage 3 (FIG. 1) from the air cleaner 2 via the regions B and the sector shaped openings 29. At this time, since the flow of the sucked air is restricted by the rotatable controlling body 21, a vacuum is produced in the intake passage 3 (FIG. 1). In addition, since the regions A are only connected to the intake passage 3 (FIG. 1) via the vacuum holes 32 as mentioned above, a vacuum having the same pressure as that in the intake passage 3 (FIG. 1) is produced within the regions A. As mentioned previously, since the coil spring 35 provides an approximately constant torque to the controlling body 21 in spite of the position of the controlling body 21, the controling body 21 rotates so that the pressure difference between the pressure in the regions B and the vacuum in the regions A is maintained at a constant value; that is, the flow velocity of the sucked air passing through the openings 29 of the bottom wall 30 is maintained at a constant level. As will be understood from FIG. 3, the cross-sectional area of the openings 29 is increased as the rotation angle of the controlling body 21 is increased so that the cross-sectional area of the opening 29 is proportional to the rotation angle of the controlling body 21. Consequently, since the flow velocity of the sucked air passing through the openings 29 is maintained at a constant level, the amount of the sucked air passing through the openings 29 is proportional to the cross-sectional area of the openings 29. Therefore, the rotation angle of the controlling body 21 is proportional to the amount of the sucked air fed into the intake passage 3 (FIG. 1).

Figure 6:
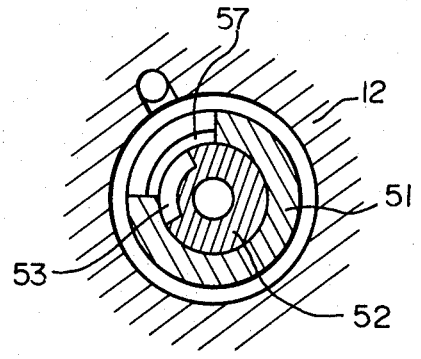
FIG. 6 is a cross-sectional view of a flow control valve, taken along the line VI—VI in FIG. 1.

As illustrated in FIG. 1 a fuel metering device 50 is arranged in the injection body 12. The fuel metering device 50 comprises a hollow cylinder 51 fitted into the center of the injector body 12 via three O rings, and a plunger 52 rotatably inserted into a cylinder 51 and formed in one piece with the shaft 25. The plunger 52 of the shaft 25 is supported by the top of the cylinder 51 via a thrust bearing 26. As illustrated in FIGS. 1 and 6, a sector shaped cut away portion 53 and an annular cut away portion 54, connected to the sector shaped cut away portion 53, are formed on the outer wall of the plunger 52. In addition, a central axial bore 55 is formed in the plunger 52. A sector shaped metering slot 57, extending in the circumferential direction of the inner wall of the cylinder 51, is formed on the inner wall of the cylinder 51 and arranged to be connectable to the sector shaped cut away portion 53. This cut away portion 53 has a uniform height over the entire length thereof. In addition, a plurality of fuel inflow bores 58, connected to a cut away portion 54 of the plunger 52, is formed on the inner wall of the cylinder 51. Furthermore, a pin 59 is inserted between the lower end of the cylinder 51 and the injector body 12 for positioning the cylinder 51 is a predetermined position. As mentioned above, the metering slot 57 of the cylinder 51 has a uniform height over the entire length thereof. Consequently, the cross-sectional area of the intersecting zone of the metering slot 57 and the sector shaped cut away portion 53 is proportional to the rotation angle of the plunger 52. On the other hand, as mentioned previously, the rotation angle of the controlling body 21 (FIG. 2) is proportional to the amount of the sucked air fed into the intake passage 3 (FIG. 1). Therefore, the cross-sectional area of the intersecting zone of the metering slot 57 and the cut away portion 53 is proportional to the amount of the sucked air.

Figure 7:
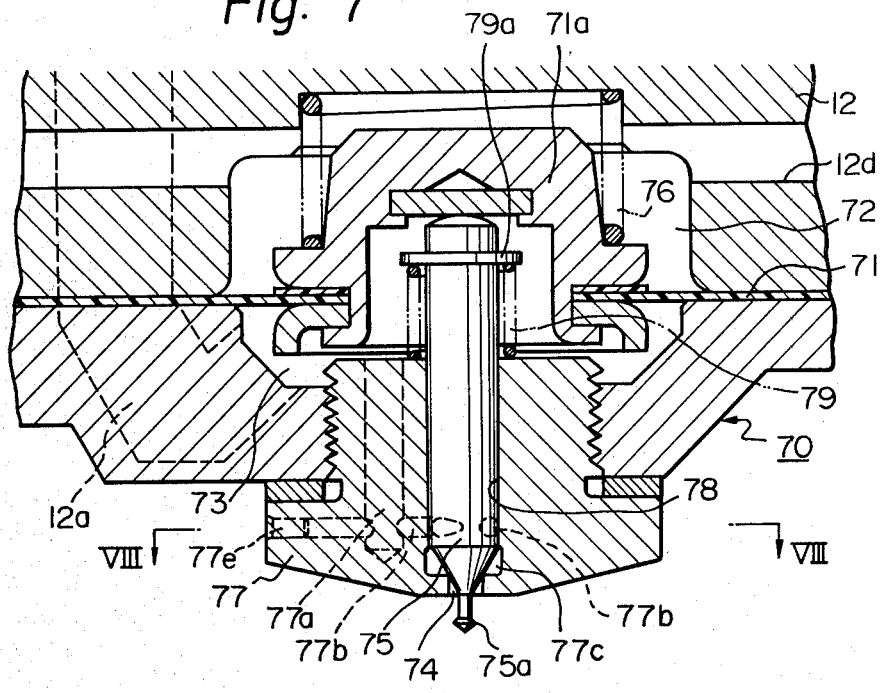
FIG. 7 is an enlarged cross-sectional view of an injector unit illustrated in FIG. 1.
Figure 8:
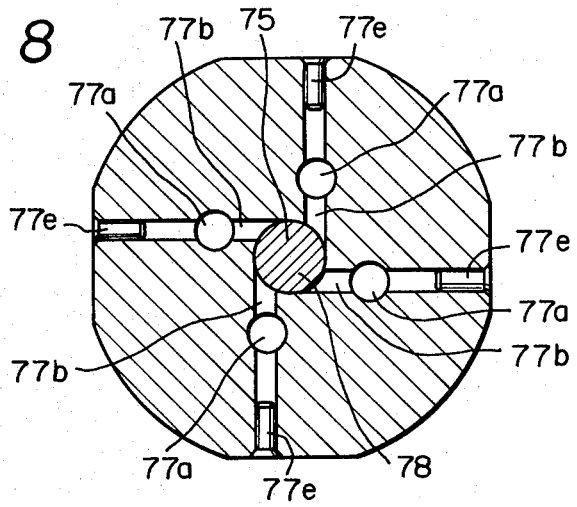
FIG. 8 is a cross-sectional plan view, taken along the line VIII—VIII in FIG. 7.

Referring to FIGS. 1 and 7, an injector unit 70 is arranged in the injector body 12. This injector unit 70 comprises a back pressure chamber 72 and a fuel chamber 73, which are separated by a diaphragm 71. A movable support member 71*a* is fixed onto the center of the diaphragm 71. A nozzle holder 77 is screwed into the lower end of the injector unit 70, and a needle 75 is slidably inserted into a bore 78 formed in the nozzle holder 77. A first compression spring 79 is arranged within the fuel chamber 73 between the nozzle holder 77 and a projection 79*a* formed on the plunger 75 so that the plunger 75 is biased upwards by the spring force of the first compression spring 79. In addition, a second compression spring 76, which is stronger than the first compression spring 79, is arranged within the back pressure chamber 72 between a movable support member 71*a* and the injector body 12 so that the plunger 75 is biased downwards by the spring force of the second compression spring 76. As illustrated in FIGS. 7 and 8, four vertical fuel bores 77*a*, connected to the fuel chamber 73, are formed in the nozzle holder 77. In addition, four horizontal fuel bores 77*b*, connected to the corresponding vertical fuel bores 77*a*, are formed in the nozzle holder 77. One end of each of the horizontal fuel bores 77*b* is tangentially connected to the circumferential inner wall of the bore 78, and the other ends of the fuel bores 77*b* are closed by blind plugs 77*e*. A nozzzle 74 is formed on the lower face of the nozzle holder 77, and a swirl chamber 77*c* is formed in the nozzle holder 77 above the nozzle 74. As illustrated in FIG. 7, the plunger 75 has on its lower end an enlarged portion 75*a*.

Referring to FIG. 1, the injector body 12 is provided with a pressure reducing valve 80. The pressure reducing valve 80 comprises a back pressure chamber 82 and a pressure reducing chamber 83, which are separated by a diaphragm 81. This diaphragm 81 has a valve plate 89. A fuel return pipe 84 is arranged in the pressure reducing chamber 83 so as to project towards the valve plate 89. In addition, a first compression spring 85 is arranged in the pressure reducing chamber 83 for biasing the diaphragm 81 towards the left in FIG. 1. A second compression spring 88 is arranged within the back pressure chamber 82 between the diaphragm 81 and a spring retainer 87 for biasing the diaphragm 81 towards the right in FIG. 1. The spring retainer 87 is supported by an adjusting screw 86 so that the strength of the second compression spring 88 can be easily adjusted.

As illustrated in FIG. 1 a fuel feed pump 91 is provided, which is driven by an electrical motor M. The suction side of the fuel feed pump 91 is connected to a fuel tank 93 via a fuel filter 92, and the discharge side of the fuel feed pump 91 is connected to the fuel tank 93 via constant pressure valve 94. Consequently, the fuel having a constant pressure is discharged from the discharge side of the fuel feed pump 91. The discharge side of the fuel feed pump 91 is connected to the fuel inflow bores 58 of the fuel metering device 50 via a fuel conduit 95 and a fuel passage 14*a* formed in the injector body 12. In addition, the metering slot 57 of the cylinder 51 of the fuel metering device 50 is connected to the fuel chamber 73 of the injector unit 70 via a fuel passage 12*a* which is formed in the injector body 12. Consequently, the fuel, discharged from the fuel feed pump 91, is fed into the fuel chamber 73 via the metering slot 57. In addition, the discharge side of the fuel feed pump 91 is connected, to the back pressure chamber 82 and, to the pressure reducing chamber 83 via a restricted opening 97 having a fixed cross-sectional area. The fuel return pipe 84 of the pressure reducing valve 80 is connected to the axial bore 55 of the plunger 52 via a fuel passage 12*c* and also to the fuel tank 93 via a fuel conduit 99 and a pressure holding valve 98 which is opened when the pressure in the fuel return pipe 84 is increased beyond a predetermined level. In addition, the pressure reducing chamber 83 of the pressure reducing valve 80 is connected to the back pressure chamber 72 of the injector unit 70 via a restricted opening 16 and a fuel passage 12*b* which is formed in the injector body 12. Furthermore, the back pressure chamber 72 is connected to the fuel tank 93 via a fuel passage 12*b*, formed in the injector body 12, and via a fuel conduit 100 and the electromagnetic valve 11.

Figure 9:
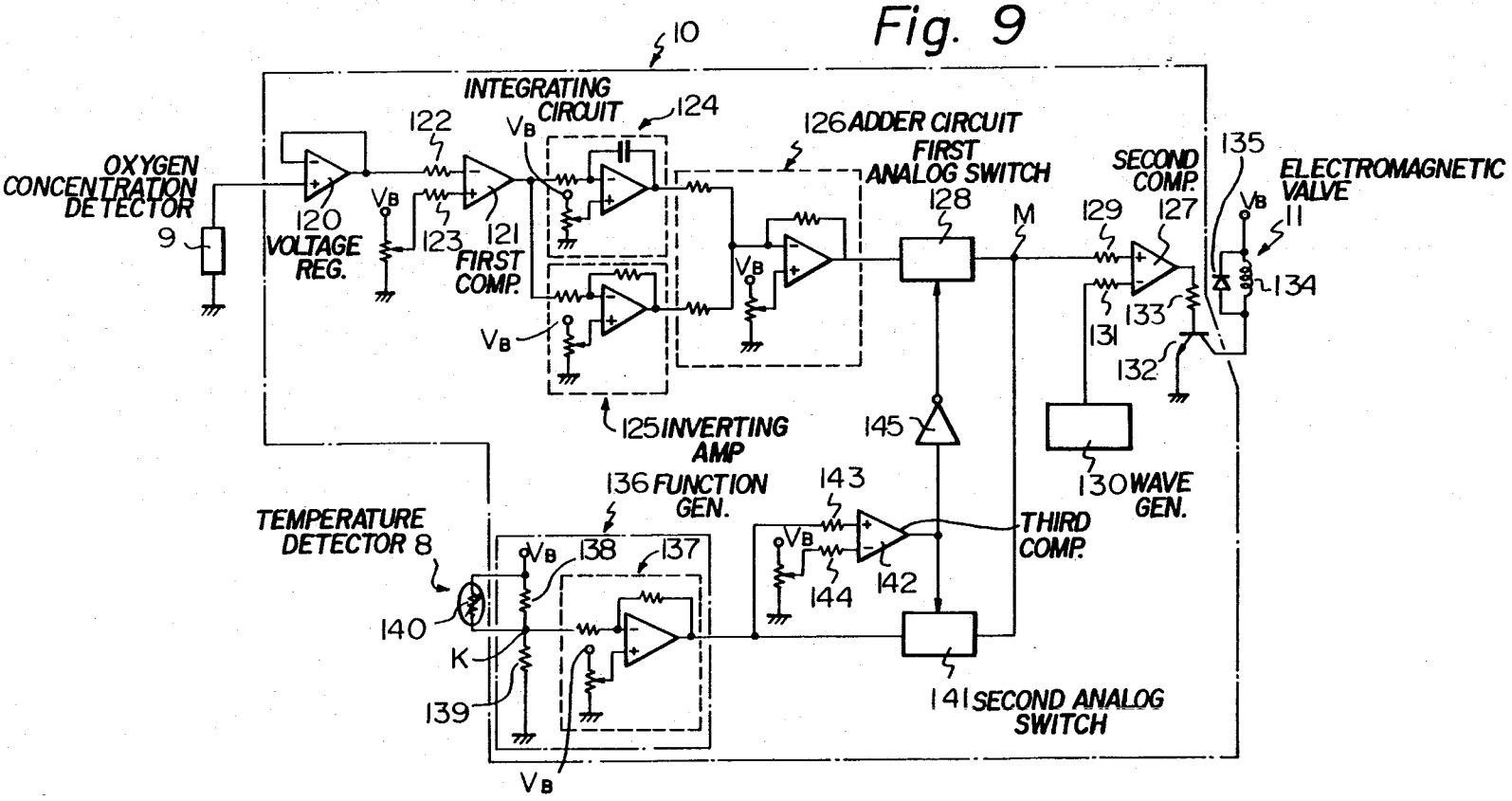
FIG. 9 is a view illustrating an electronic control circuit.

Referring to FIG. 9, the electronic control circuit 10 comprises a voltage follower 120 and a first comparator 121. The non-inverting input terminal of the voltage follower 120 is connected to the oxygen concentration detector 9. The output terminal of the voltage follower 120 is connected to the inverting input terminal of the first comparator 121 via a resistor 122, and the reference voltage is applied to the non-inverting input terminal of the first comparator 121 via a resistor 123. The output terminal of the first comparator 121 is connected to the input terminal of an integrating circuit 124 and also to the input terminal of an inverting amplifier 125. The output terminal of the integrating circuit 124 is connected to the first input terminal of an adder circuit 126, and the output terminal of the amplifier 125 is connected to the second input terminal of the adder circuit 126. The output terminal of the adder circuit 126 is connected to the non-inverting input terminal of a second comparator 127 via a first analog switch 128 and a resistor 129, and the inverting input terminal of the second comparator 127 is connected to a saw tooth shaped wave generator 130 via a resistor 131. The output terminal of the second comparator 127 is connected to the base of a transistor 132 via a resistor 133. The emitter of the transistor 132 is grounded, and the collector of the transistor 132 is connected to a power source $V_B$ via a solenoid 134 of the electromagnetic valve 11. A diode 135, for absorbing surge electric current, is connected parallel to the solenoid 134.

As illustrated in FIG. 9, the electronic control circuit 10 further comprises a function generator 136 which comprises an inverting amplifier 137 and a pair of resistors 138, 139. One end of the resistor 138 is connected to the power source $V_B$, and the other end of the resistor 138 is connected to one end of the resistor 139. The other end of the resistor 139 is grounded. The temperature detector 8 comprises a thermistor 140. This thermistor 140 is connected, parallelly, to the resistor 138. The input terminal of the amplifier 137 is connected to the connecting point K of the resistors 138 and 139. The output terminal of the function generator 136 is connected to the connecting point K of the first analog switch 128 and to the resistor 129 via a second analog switch 141 and to the non-inverting input terminal of a third comparator 142 via a resistor 143. The reference voltage is applied to the inverting input terminal of the third comparator 142 via a resistor 144. The output terminal of the third comparator 142 is connected to the first analog switch 128 via an invertor 145 and to the second analog switch 141 so that the first analog switch 128 and the second analog switch 141 are controlled by the output voltage of the third comparator 142.

Figure 10:
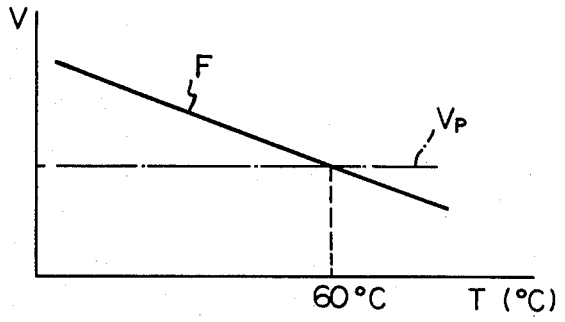
FIG. 10 is a graph illustrating the relationship between the output voltage of the function generator and the temperature of the cooling water of an engine.

The resistance value of the thermistor 140 is reduced as the temperature of the thermistor 140 is increased, that is, as the temperature of the cooling water of the engine 1 is increased. Consequently, the voltage level at the connecting point K of the function generator 136 is increased as the temperature of the cooling water is increased. Therefore, the output voltage of the function generator 136 is reduced as the temperature of the cooling water is increased as illustrated by a solid line F in FIG. 10. In FIG. 10, an ordinate V indicates the output voltage of the function generator 136, and an abscissa T indicates the temperature of the cooling water. In addition, in FIG. 10, $V_P$ indicates the reference voltage which is applied to the inverting input terminal of the third comparator 142. From FIG. 10, it will be understood that, when the temperature of the cooling water is below 60° C., the output voltage of the function generator 136 is higher than the reference voltage $V_P$. Consequently, the more the temperature of the cooling water is reduced below 60° C., the greater the increase of the output voltage of the third comparator 142. Therefore, when this occurs, the first analog switch 128 is in the non-conductive state, and the second analog switch 141 is in the conductive state. However, when the temperature of the cooling water is above 60° C., since the output voltage of the function generator 136 is lower than the reference voltage $V_P$, the output voltage of the third comparator 142 decreases. As a result of this, the first analog switch 128 is changed to the conductive state, and the second analog switch 141 is changed to the non-conductive state.

Figure 11:
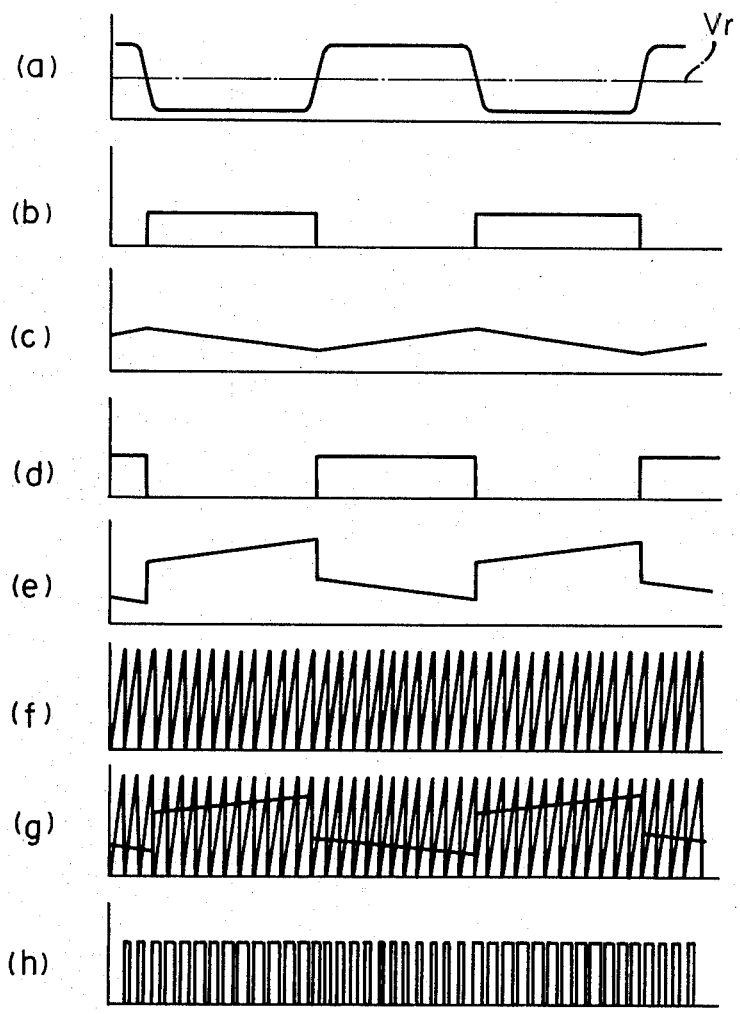
FIG. 11 is a time chart illustrating the change in the voltage applied to the non-inverting input terminal of the second comparator.

As is known to those skilled in the art, when an air-fuel ratio of the mixture, fed into the cylinders of the engine 1, is larger than the stoichiometric air-fuel ratio, the output voltage of the oxygen concentration detector 9 becomes equal to about 0.1 volt. However, when an air-fuel ratio of the mixture, fed into the cylinders of the engine 1, is less than the stoichiometric air-fuel ratio, the output voltage of the oxygen concentration detector 9 becomes equal to about 0.9 volt. FIG. 11(*a*) indicates the output voltage of the oxygen concentration detector 9. The output voltage of the oxygen concentration detector 9 is applied to the inverting input terminal of the first comparator 121 via the voltage follower 120 and the resistor 122. In FIG. 11(*a*), $V_r$ indicates the reference voltage which is applied to the non-inverting input terminal of the first comparator 121. The output voltage of the first comparator 121 becomes high when the voltage, applied to the inverting input terminal of the first comparator 121, is reduced below the reference voltage $V_r$. Consequently, the first comparator 121 produces the output voltage as illustrated in FIG. 11(*b*). The output voltage of the first comparator 121 is integrated in the integrating circuit 124 and, thus, the integrating circuit 124 produces the output voltage as illustrated in FIG. 11(*c*). In addition, the output voltage of the first comparator 121 is amplified in the inverting amplifier 125 and, thus, the inverting amplifier 125 produces the output voltage as illustrated in FIG. 11(*d*). The output voltage of the integrating circuit 124 and the output voltage of the inverting amplifier 125 are added in the adder circuit 126 and, thus, the adder circuit 126 produces the output voltage as illustrated in FIG. 11(*e*). Assuming that the temperature of the cooling water of the engine 1 is above 60° C., the first analog switch 128 is in the conductive state, and the second analog switch 141 is in the non-conductive state as mentioned above. Consequently, in such a case, the output voltage of the adder circuit 126 is applied to the non-inverting input terminal of the second comparator 127 via the first analog switch 128 and the resistor 129. The saw tooth shaped wave generator 130 generates a saw tooth shaped wave having a constant frequency as illustrated in FIG. 11(*f*), and this saw tooth shaped wave is fed into the inverting input terminal of the second comparator 127 via the resistor 131. The output voltage of the adder circuit 126 and the voltage of the saw tooth shaped wave are compared in the second comparator 127 as illustrated in FIG. 11(*g*). The output voltage of the second comparator 127 becomes high when the output voltage of the adder circuit 126 is greater than the voltage of the saw tooth shaped wave generator 130. Consequently, the second comparator 127 produces continous output pulses as illustrated in FIG. 11(*h*). From FIGS. 11(*a*) and (*h*), it will be understood that, when the output voltage of the oxgen concentration detector 9 becomes low, that is, when an air-fuel ratio of the mixture, fed into the cylinders of the engine 1, becomes larger than the stoichiometric air-fuel ratio, the widths of the output pulses of the second comparator 127 are widened. As the widths of the output pulses of the second comparator 127 are widened, the amount of electric current, flowing within the solenoid 134 of the electromagnetic valve 11, is increased. The electromagnetic valve 11 is so constructed that, the flow area thereof is increased as the amount of electric current, flowing within the solenoid 134, is increased. Consequently, the flow area of the electromagnetic valve 11 is increased when an air-fuel ratio of the mixture, fed into the cylinders of the engine 1, is larger than the stoichiometric air-fuel ratio, while the flow area of the electromagnetic valve 11 is reduced when an air-fuel ratio of the mixture, fed into the cylinders of the engine 1, is less than the stoichiometric air-fuel ratio.

Figure 12:
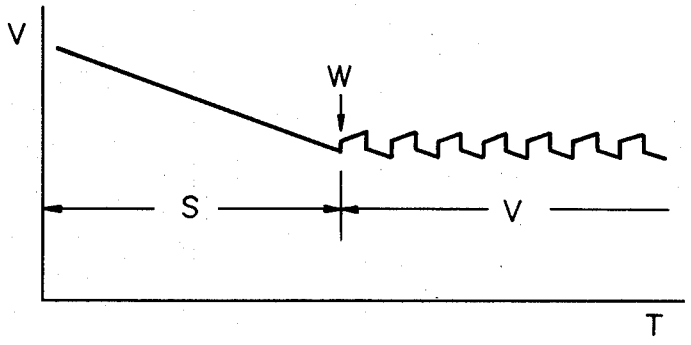
FIG. 12 is a time chart illustrating the change in the voltage in the electronic control circuit

When the temperature of the cooling water of the engine 1 is below 60° C., the first analog switch 128 is in the non-conductive state, and the second analog switch 141 is in the conductive state as mentioned previously. Consequently, when this occurs, the output voltage of the function generator 136, which is indicated by the solid line F in FIG. 10, is applied to the non-inverting input terminal of the second comparator 127. FIG. 12 illustrates a change in voltage applied to the non-inverting input terminal of the second comparator 127. In FIG. 12, an ordinate V indicates the voltage applied to the non-inverting input terminal of the second comparator 127, and an abscissa T indicates time. In addition, in FIG. 12, a point W indicates the moment when the temperature of the cooling water of the engine becomes equal to 60° C. In other words, in FIG. 12, a section S indicates the case wherein the temperature of the cooling water is below 60° C. and therefore the output voltage of the function generator 136 is applied to the non-inverting input terminal of the second comparator 127. In addition, a section V in FIG. 12 indicates the case wherein the temperature of the cooling water is above 60° C. and therefore the output voltage of the adder circuit 126 is applied to the non-inverting input terminal of the second comparator 127. From FIG. 12, it will be understood that the level of the output voltage of the function generator 136 at the point W is approximately equal to that the output voltage of the adder circuit 126, and that the output voltage of the function generator 136 is generally higher than that of the adder circuit 126. Consequently, it will be also understood that, when the temperature of the cooling water is below 60° C., the flow area of the electromagnetic valve 11 becomes larger than a case wherein the temperature of the cooling water is above 60° C.

As mentioned previously with reference to FIG. 1, the pressure of fuel in the discharge side of the fuel feed pump 91 is maintained constant. This constant discharge pressure is hereinafter indicated by $P_o$. When the engine 1 is started, the fuel feed pump 91 is operated. As a result of this, the fuel, discharge from the fuel feed pump 91, is fed to the back pressure chamber 82 of the pressure reducing valve 80 and, also to the pressure reducing chamber 83 via the restricted opening 97. Consequently, the pressure in the back pressure chamber 82 becomes equal to the constant discharge pressure $P_o$. In the pressure reducing valve 80, the first compression spring 85 has a spring force which is stronger than that of the second compression spring 88 so that, when the pressure in the pressure reducing chamber 83 is increased beyond a predetermined pressure which is smaller than the pressure $P_o$ in the back pressure chamber 82, the valve plate 89 opens the unconnected end of the fuel return pipe 84 for returning the fuel in the pressure reducing chamber 83 to the fuel tank 93 via the fuel return pipe 84 and the fuel conduit 99. Consequently, the pressure reducing chamber 83 is maintained at a constant pressure which is lower than the pressure $P_o$ in the back pressure chamber 82 by $\Delta P_1$. At this time, if the flow area of the electromagnetic valve 11 is maintained constant, the fuel within the pressure reducing chamber 83 flows, at a constant rate, into the back pressure chamber 72 of the injector unit 70 via the restricted opening 16 and the fuel passage **12*b* and then into the fuel tank 93 via the fuel passage 12*d*, the fuel conduit 100 and the electromagnetic valve 11. When the fuel passes through the restricted opening 16, a constant pressure drop $\Delta P_2$ takes place and, as a result, the pressure in the back pressure chamber 72 becomes lower than that in the pressure reducing chamber 83 by $\Delta P_2$. Consequently, the pressure $P_a$ in the back pressure chamber 72** is indicated by the following equation.

$$P_a = P_0 - P_1 - P_2$$

As mentioned previously, in FIG. 7, the second compression spring 76 has a spring force which is stronger than that of the first compression spring 79 so that, when the pressure in the fuel chamber 73 becomes larger than the pressure $P_a$ in the back pressure chamber 72 by $\Delta P_3$, the diaphragm 71 moves upwards together with the plunger 75. When the plunger 75 moves upwards, since the open ends of the fuel bores **77*b* are uncovered by the plunger 75, the fuel within the fuel chamber 73 flows into the bore 78. The first and second compression springs 79, 76 are so constructed that they have approximately constant respective spring forces in spite of the position of the plunger 75. Consequently, when the pressure difference between the pressure in the back pressure chamber 72 and the pressure in the fuel chamber 73 becomes larger than the above-mentioned $\Delta P_3$, the plunger 75 moves upwards to increase the open area of the open ends of the fuel bores 77*b* for reducing the pressure in the fuel chamber 73. However, when the pressure difference between the pressure in the back pressure chamber 72 and the pressure in the fuel chamber 73 becomes smaller than the above-mentioned $\Delta P_3$, the plunger 75 moves downwards to reduce the open area of the open ends of the fuel bores 77*b* for increasing the pressure in the fuel chamber 73. As a result of this, the pressure in the fuel chamber 73 is maintained constant. The pressure $P_b$ in the fuel chamber 73** is indicated by the following equation.

$$P_b = P_a + \Delta P_3$$

Referring to FIG. 1, the fuel, discharged from the fuel feed pump 91, is fed into the fuel inflow bores 58 via the fuel conduit 95 and the fuel passage **14*a* and then into the sector shaped cut away portion 53 via the annular cut away portion 54. Consequently, the pressure in the sector shaped cut away portion 54, located upstream of the metering slot 57, becomes equal to the constant discharge pressure $P_o$. On the other hand, the pressure in the fuel passage 12*a*, connected to the fuel chamber 73 and located downstream of the metering slot 57, is equal to the constant pressure $P_b$. Therefore, the pressure difference between the upstream side and the downstream side of the metering slot 57** is maintained constant. This constant pressure difference $\Delta P_c$ is indicated by the following equation.

$$\Delta P_c = P_o - P_b = P_o - P_a - \Delta P_3$$

As mentioned previously, the cross-sectional area of the intersecting zone of the metering slot 57 and the sector shaped cut away portion 54 is increased proportionally to an increase in the amount of air sucked into the intake passage 3. In addition, the pressure difference $\Delta P_c$ between the upstream side and the downstream side of the metering slot 57 is maintained constant. Consequently, the amount of fuel, passing through the metering slot 57, is increased proportionally to an increase in the amount of air sucked into the intake passage 3. Therefore, the amount of fuel fed into the cylinders of the engine 1 is proportional to the amount of air fed into the cylinders.

Referring to FIG. 7, when the plunger 75 moves upwards, since a swirl chamber **77*c* is connected to the intake passage 3 (FIG. 1), the constant vacuum, which is almost the same as that in the intake passage 3, is produced in the swirl chamber 77*c*. Consequently, since the pressure difference between the pressure in the swirl chamber 77*c* and the pressure in the fuel chamber 73 is maintained constant, the fuel flows into the bore 78 from the fuel bores 77*b* at a constant high speed independently of the amount of fuel fed into the cylinders of the engine 1. As illustrated in FIG. 8, the open end of each of the fuel bores 77*b* is tangentially connected to the circumferential inner wall of the bore 78. Consequently, the fuel, flowing out from the fuel bores 77*b*, is caused to swirl along the circumferential inner wall of the bore 78. Then, the fuel is injected, while swirling, into the main intake passage 4A from the nozzle 74 towards the throttle valve 13 via the swirl chamber 77***c*. A part of the fuel, injected from the nozzle 74, inpinges upon the enlarged portion 75*d* formed on the lower end of the plunger 75 and, thus, the vaporization of the fuel is promoted.

As mentioned previously, when an air-fuel ratio of the mixture, fed into the cylinders of the engine 1, becomes larger than the stoichiometric air-fuel ratio, that is, when the output voltage of the oxygen concentration detector 9 becomes low, the flow area of the electromagnetic valve 11 is increased. When this occurs, since the amount of fuel, returned from the pressure reducing chamber 83 to the fuel tank 93 via the back pressure chamber 72, is increased, the pressure drop at the restricted opening 16 is increased. As a result of this, the pressure $P_a$ in the back pressure chamber 72 is reduced. As mentioned previously, the pressure difference $\Delta P_c$ between the upstream side and the downstream side of the metering slot 57 is indicated by the following equation.

$$\Delta P_c = P_o - P_a - P_3$$

Therefore, if the pressure $P_a$ in the back pressure chamber 72 is reduced as mentioned above, since the pressure difference $\Delta P_c$ between the upstream side and the downstream side of the metering slot 57 is increased, the amount of fuel, passing through the metering slot 57, is increased. As a result of this, since the amount of fuel, injected from the nozzle 74, is increased, an air-fuel ratio of the mixture, fed into the cylinders of the engine 1, becomes small.

Contrary to this, when an air-fuel ratio of the mixture, fed into the cylinders of the engine 1, becomes smaller than the stoichiometric air-fuel ratio, the flow area of the electromagnetic valve 11 is reduced as mentioned previously. As a result of this, since the pressure $P_a$ in the back pressure chamber 72 is increased, the pressure difference $\Delta P_c$ between the upstream side and the downstream side of the metering slot 57 is reduced. Thus, the amount of fuel, injected from the nozzle 74, is reduced and, therefore, an air-fuel ratio of the mixture, fed into the cylinders of the engine 1, becomes large. Thus, an air-fuel ratio of the mixture, fed into the cylinders of the engine 1, becomes equal to the stoichiometric air-fuel ratio.

In order to ensure a stable combustion when the temperature of the engine 1 is low, it is necessary to reduce an air-fuel ratio of the mixture fed into the cylinders of the engine 1 and, in addition, it is preferable that an air-fuel ratio of the mixture, fed into the cylinders of the engine 1, be reduced as the temperature of the engine 1 is reduced. To this end, in the present invention, when the temperature of the cooling water of the engine 1 is below 60° C., the flow area of the electromagnetic valve 11 is increased as the temperature of the cooling water is reduced as described with reference to FIG. 12. From the above description, it will be understood that, if the flow area of the electromagnetic valve 11 is increased, an air-fuel mixture, fed into the cylinder of the engine 1, is reduced below the stoichiometric air-fuel ratio. Consequently, in the present invention, good combustion can be ensured even when the temperature of the engine 1 is low.

When the engine 1 is stopped, the metering slot 57 is completely closed, and the fuel feed pump 91 is stopped. At this time, the plunger 52 moves downwards due to the spring force of the second compression spring 76 and closes the nozzle 74 immediately after the engine 1 is stopped. Consequently, the injecting operation of the fuel can be completely stopped immediately after the engine 1 is stopped. In addition, as mentioned above, since the plunger 52 closes the nozzle 74 immediately after the engine 1 is stopped, the pressure in the fuel chamber 73 is maintained at a relatively high level. Consequently, when the engine 1 is rotated by the starter for starting the engine 1 and, thus, the fuel is fed into the fuel chamber 73, the pressure in the fuel chamber 73 is immediately increased. Therefore, since the plunger 75 opens the nozzle 74 immediately after the engine 1 is rotated by the starter, there is no danger of an injection delay occuring.

In addition, when the engine 1 is stopped, and the fuel feed pump 91 is stopped, since the diaphragm 81 of the pressure reducing valve 80 moves towards the left in FIG. 1, the valve plate 89 opens the fuel return pipe 84. However, since the pressure holding valve 98 is arranged in the fuel conduit 99, and the constant pressure valve 94 is arranged between the fuel conduit 95 and the fuel tank 93, the pressure in the back pressure chambers 72 and 82 and in the pressure reducing chamber 83 is maintained at a relatively high pressure.

In addition, as illustrated in FIG. 1, a bypass conduit 111, in which a flow control valve 112 is arranged, may be connected to the fuel conduit 100 so as to bypass the electromagnetic valve 11. The flow area of the flow control valve 112 can be controlled in accordance with a change in the temperature of air sucked into the cylinders of the engine, or in accordance with a change in the atmospheric pressure. Furthermore, a plurality of flow control valves may be arranged in a series in the bypass conduit 111.

According to the present invention, in a fuel injection device of a continuous injection type as illustrated in FIG. 1, it is possible to precisely equalize an air-fuel ratio of the mixture, fed into the cylinders of the engine, to the stoichiometric air-fuel ratio. In addition, when the temperature of the engine is low, since an air-fuel ratio of the mixture, fed into the cylinders of the engine, is reduced below the stoichiometric air-fuel ratio, it is possible to ensure good combustion even when the temperature of the engine is low. Furthermore, there are the advantages that the injecting operation of the fuel can be stopped immediately after the engine is stopped, and that the injecting operation of the fuel can be started immediately after the engine is rotated by the starter.

While the invention has been described by reference to a specific embodiment chosen for purposes of illustration, it should be apparent that numerous modifications could be made thereto by those skilled in the art without departing from the spirit and scope of the invention.

We claim:

1. A fuel injection device of an internal combustion engine having an intake passage and an exhaust passage, said device comprising:

a fuel reservoir;

fuel feed means connected to said fuel reservoir and discharging fuel of a constant pressure;

an injector unit having a fuel chamber, a back pressure chamber, a diaphragm separating said fuel chamber from said back pressure chamber, and a plunger operatively connected to said diaphragm, said fuel chamber having a fuel nozzle which opens into said intake passage and cooperates with said plunger for forming a mixture in said intake passage, said injector unit further comprising spring means for biasing said plunger towards said fuel nozzle for closing said fuel nozzle by said plunger when the engine is stopped;

a fuel feed passage connecting said fuel feed means to said fuel chamber;

flow control means arranged in said fuel feed passage for controlling the flow of a fuel to feed the fuel into said fuel chamber in an amount which is proportional to the amount of sucked air flowing within said intake passage;

pressure reducing mean connected to said fuel feed means and having a pressure reducing chamber for maintaining a fuel within said pressure reducing chamber at a constant pressure which is smaller than the constant pressure of the fuel discharged from said fuel feed means, said pressure reducing chamber being connected to said fuel chamber via a restricted opening;

a fuel return passage connecting said fuel chamber to said fuel reservoir;

an oxygen concentration detector in said exhaust passage for alternately producing a low level signal and a high level signal, said low level signal representing an air-fuel ratio of said mixture that is larger than the stoichiometric air-fuel ratio, said high level signal representing an air-fuel ratio of said mixture that is less than the stoichiometric air-fuel ratio;

control means for producing continuous output pulses having a constant period, but variable pulse widths which vary in response to said low level signal and said high level signal; and, valve means in said fuel return passage for controlling a flow area of said fuel return passage in response to the output pulses of said control means to reduce and increase the pressure in said back pressure chamber when said oxygen concentration detector produces said low level signal and said high level signal, respectively.

2. A fuel injection device as claimed in claim 1, wherein said spring means comprises a first compression spring for biasing said plunger towards said back pressure chamber, and a second compression spring for biasing said plunger towards said fuel chamber, said second compression spring having a spring force which is stronger than that of said first compression spring.

3. A fuel injection device of an internal combustion engine having an intake passage and an exhaust passage, said device comprising:

a fuel reservoir;

fuel feed means connected to said fuel reservoir and discharging fuel of a constant pressure;

an injector unit having a fuel chamber, a back pressure chamber, a diaphragm separating said fuel chamber from said back pressure chamber, and a plunger operatively connected to said diaphragm, said fuel chamber having a fuel nozzle which opens into said intake passage and cooperates with said plunger for forming a mixture in said intake passage;

a fuel feed passage connecting said fuel feed means to said fuel chamber;

flow control means arranged in said fuel feed passage for controlling the flow of a fuel to feed the fuel into said fuel chamber in an amount which is proportional to the amount of sucked air flowing within said intake passage;

pressure reducing means connected to said fuel feed means and having a pressure reducing chamber for maintaining a fuel within said pressure reducing chamber at a constant pressure which is smaller than the constant pressure of the fuel discharged from said fuel feed means, said pressure reducing chamber being connected to said fuel chamber via a restricted opening, said pressure reducing means comprises a back pressure chamber, a second diaphragm separating said pressure reducing chamber from said back pressure chamber of said pressure reducing means, a valve plate mounted on said diaphragm, spring means for biasing said second diaphragm towards said back pressure chamber of said pressure reducing means, and a fuel return pipe connected to said fuel reservoir and having an opening which opens into said pressure reducing chamber and cooperating with said valve plate, said back pressure chamber of said pressure reducing means being directly connected to said fuel feed means, and said pressure reducing chamber being connected to said fuel feed means via a restricted opening, said spring means comprises a first compression spring for biasing said second diaphragm of said pressure reducing means towards said back pressure chamber thereof, and a second compression spring for biasing said second diaphragm of said pressure reducing means towards said pressure reducing chamber, said first compression spring having a spring force which is stronger than that of said second compression spring, said pressure reducing means further comprises an adjusting screw and a spring retainer supported by said said adjusting screw, said second compression spring being arranged between said spring retainer and said second diaphragm of said pressure reducing means;

a fuel return passage connecting said fuel chamber to said fuel reservoir;

an oxygen concentration detector in said exhaust passage for alternately producing a low level signal and a high level signal, said low level signal representing an air-fuel ratio of said mixture that is larger than the stoichiometric air-fuel ratio, said high level signal representing an air-fuel ratio of said mixture that is less than the stoichiometric air-fuel ratio;

control means for producing continuous output pulses having a constant period, but variable pulse widths which vary in response to said low level signal and said high level signal; and valve means in said fuel return passage for controlling a flow area of said fuel return passage in response to the output pulses of said control means to reduce and increase the pressure in said back pressure chamber when said oxygen concentration detector produces said low level signal and said high level signal, respectively.

4. A fuel injection device of an internal combustion engine having an intake passage and an exhaust passage, said device comprising;

a fuel reservoir;

fuel feed means connected to said fuel reservoir and discharging fuel of a constant pressure;

an injector unit having a fuel chamber, a back pressure chamber, a diaphragm separating said fuel chamber from said back pressure chamber, and a plunger operatively connected to said diaphragm, said fuel chamber having a fuel nozzle which opens into said intake passage and cooperates with said plunger for forming a mixture in said intake passage;

a fuel feed passage connecting said fuel feed means to said fuel chamber;

flow control means arranged in said fuel feed passage for controlling the flow of a fuel to feed the fuel into said fuel chamber in an amount which is proportional to the amount of sucked air flowing within said intake passage;

pressure reducing means connected to said fuel feed means and having a pressure reducing chamber for maintaining a fuel within said pressure reducing chamber at a constant pressure which is smaller than the constant pressure of the fuel discharged from said fuel feed means, said pressure reducing chamber being connected to said fuel chamber via a restricted opening;

a fuel return passage connecting said fuel chamber to said fuel reservoir;

an oxygen concentration detector in said exhaust passage for alternately producing a low level signal and a high level signal, said low level signal representing an air-fuel ratio of said mixture that is larger than the stoichiometric air-fuel ratio, said high level signal representing an air-fuel ratio of said mixture that is less than the stoichiometric air-fuel ratio;

control means for producing continuous output pulses having a constant period, but variable pulse widths which vary in response to said low level signal and said high level signal;

valve means in said fuel return passage for controlling a flow area of said fuel return passage in response to the output pulses of said control means to reduce and increase the pressure in said back pressure chamber when said oxygen concentration detector produces said low level signal and said high level signal, respectively;

said control means comprises a first comparator connected to said oxygen concentration detector and producing an output signal when said oxygen concentration detector produces said low level signal, an integrating circuit for integrating the output signal of said first comparator to produce an output signal, a saw tooth shaped wave generator for generating a saw tooth shaped output signal having a constant frequency, and a second comparator for comparing the output signal of said integrating circuit with the output signal of said saw tooth shaped wave generator to produce said continuous output pulses having widths which are widened when the oxygen concentration detector produces said low level signal, said valve means increasing the flow area of said fuel return passage in accordance with an increase in the widths of said continuous output pulses; and a temperature detector having a thermistor the resistant value of which varies in accordance with a change in the temperature of the engine, said control means comprising a function generator connected to said thermistor for generating an output signal having a voltage level which is larger than that of the output signal of said integrating circuit, and switching means for selectively feeding the output signal of said integrating circuit or the output signal of said function generator into said second comparator in response to the temperature of the engine, the output signal of said integrating circuit and the output signal of said function generator being fed into said second comparator when the temperature of the engine is above and below predetermined levels, respectively.

5. A fuel injection device as claimed in claim 4, wherein said function generator comprises an amplifier for producing the output signal having a voltage level which is reduced in accordance with an increase in the temperature of the engine, said switching means being connected to said amplifier for selectively feeding the output signal of said integrating circuit or the output signal of said function generator into said second comparator in response to the output signal of said function generator.

6. A fuel injection device as claimed in claim 5, wherein said switching means comprises a third comparator comparing the output signal of said function generator with a reference voltage for producing an output signal when the temperature of the engine is below a predetermined level, a first analog switch inserted between said integrating circuit and said second comparator and connected to said third comparator via an invertor, and a second analog switch inserted between said function generator and said second comparator and connected to said third comparator, said first and second analog switches being controlled by the output signal of said third comparator.

* * * * *